US006392131B2

(12) United States Patent
Boyer

(10) Patent No.: US 6,392,131 B2
(45) Date of Patent: May 21, 2002

(54) DEVICE FOR PATTERNED INPUT AND DISPLAY OF MUSICAL NOTES

(76) Inventor: Stephen W. Boyer, 1261 N. Pauline St., Suite 6, Chicago, IL (US) 60622

( * ) Notice: Subject to any disclaimer, the term of this patent is extended or adjusted under 35 U.S.C. 154(b) by 0 days.

(21) Appl. No.: 09/861,416

(22) Filed: May 18, 2001

Related U.S. Application Data

(60) Provisional application No. 60/210,553, filed on Jun. 9, 2000.

(51) Int. Cl.[7] ..... G10C 3/12

(52) U.S. Cl. ..... 84/424; 84/443; 84/471 R; 84/483.2

(58) Field of Search ..... 84/470 R, 471 R, 84/477, 478, 483.2, 442, 443, 743, 744, 423 R, 424, 425, 485 SR, 471 SR

(56) References Cited

U.S. PATENT DOCUMENTS 2,003,894 A * 6/1935 Luedkte
2,049,564 A * 8/1936 Hintermeyer
2,250,522 A * 7/1941 Bonilla
3,468,209 A * 9/1969 Barreto
4,031,800 A * 6/1977 Thompson ..... 84/423 R
4,677,893 A * 7/1987 Fahnestock ..... 84/473
5,415,071 A * 5/1995 Davies ..... 84/485 SR
5,741,990 A * 4/1998 Davies ..... 84/423 R

OTHER PUBLICATIONS

Hall, Donald E., *Musical Acoustics*, Wadsworth Publishing, 1980, p. 450.
Boyer, Stephen W., "Wanderings" Gallery showing Art, 2000.
English Concertina 48 key Layout and Chord Structure, Left Hand, William Meredith Cinesoud Co., 2000.
English Concertina 48 key Layout and Chord Structure, Right Hand, William Meredith Cinesoud Co., 2000.

* cited by examiner

*Primary Examiner*—Jeffrey Donels
(74) *Attorney, Agent, or Firm*—Welsh & Katz, Ltd.

(57) ABSTRACT

A device for input of musical notes and chords, each triad including a plurality of musical notes and being classified into types according to a number of notes in the chord and the tonal relationship among the notes, includes a plurality of input devices each associated with a note. The input devices are arranged in spatial relationship to each other such that the spatial relationship of input devices required to play a type of chord is the same for all triads of that type.

19 Claims, 7 Drawing Sheets

DEVICE FOR PATTERNED INPUT AND DISPLAY OF MUSICAL NOTES

CROSS-REFERENCE TO RELATED APPLICATIONS

This application is based on U.S. provisional application No. 60/210,553, filed Jun. 9, 2000.

BACKGROUND OF THE INVENTION

The field of the invention is musical instruments. In particular, the invention relates to a device for the input of musical notes and the visual display of musical notes.

Musical instruments have a long history in practically every human culture. Most instruments are designed to produce single tones. Further, the majority of musical instruments are designed such that linear manipulations of the arrangements of valves, strings, keys, pipes, holes, and the like will produce tones of rising or falling tone in a logical, linear fashion. For example, in its lower ranges, a clarinet produces successively higher tones as the lowest fingers are successively lifted, and pianos are arranged such that the tones produced by striking the keys rise from left to right.

In general existing instruments are most effectively used to play melodies, and in fact musical instruments that produce a single note at a time are limited to such play. In order to facilitate melodic play, the orthodox design approach for musical instruments conforms the instruments to various scales, wherein the patterns of manipulations that generate notes is linear as patterned after such scales. In instruments that are capable of producing chords, such as pianos, the chromatic arrangement of the keys makes the playing of chords or intervals a physical challenge requiring much practice and effort to achieve pleasant results. Accordingly, students of such instruments spend years developing the physical skills required to play their instrument.

Also, the design of present musical instruments does little to advance the understanding or learning of musical theories that elucidate the harmonic aspects of music. For example, watching the keys move on a player piano may in some general way inform the viewer as to whether the notes being played are high or low, but it does little to impart a comprehension of the relationship of those keys to each other in producing the music.

Further, both group performances and music education can be advanced by having instruments that can be linked such that the playing of one person is made visually available to another person as well as aurally available. Visual recognition of visual geometric shapes is an easier and more widespread skill than the aural recognition of harmonic shapes. A teacher could simultaneously demonstrate music both visually and aurally, or co-performers could react to each other's play based on both visual and aural cues.

Therefore, a need exists for musical instruments that facilitate the playing of music dictated primarily by harmonic rather than chromatic principles. Desirably, such instruments would be physically easy to play and provide an artist or student with visual stimulus related to music being played to deepen understanding of music theory. More desirably, such instruments would be designed to accept input and display output in a way that related to the fundamental harmonic relationships of tones. It would also be advantageous if such instruments could be linked to advance educational and performance uses of the instruments. Another desirable development would be to have instruments that visually display music in intuitively understood, simple, geometric shapes.

BRIEF SUMMARY OF THE INVENTION

One aspect of the present invention is a device for the input of musical notes and chords, a chord comprising a plurality of musical notes, wherein chords are classified into types according to the number of notes in the chord and the tonal relationship among the notes. Such a device has a plurality of input devices, each input device being associated with a note, wherein the plurality of input devices are arranged in spatial relationship to each other such that the relative spatial relationship of the subset of input devices required to play a type of chord is the same for all chords of that type.

Another aspect of the present invention is a device having a first relative spatial relationship of three spatially contiguous input devices respectively, producing or representing a major chord, a second relative spatial relationship, different from the first relative spatial relationship, of three spatially contiguous input devices respectively, producing or representing a minor chord, a third relative spatial relationship, different from the first and second relative spatial relationships, of three spatially contiguous input devices respectively, producing or representing an augmented triad, and a fourth relative spatial relationship, different from the first, second and third relative spatial relationships, of three spatially contiguous input devices or lights respectively produces or represents a diminished triad.

Another aspect of the invention is a device where the first relative spatial relationship is a triangle pointed in a first direction, the second relative spatial relationship is a triangle pointed in a second direction, opposite to the first direction, the third relative spatial relationship is a first line, and the fourth relative spatial relationship is a second line transverse to the first line.

A still further aspect of the invention is a device comprising a plurality of display elements, each display element being associated with a note wherein the activation of a input device activates the display element associated with the same note as the input device.

Another aspect of the invention concerns a device wherein the input devices are selected from the group consisting of switches, buttons and keys.

Still another aspect of the invention is a device for the input of musical notes where there are a plurality of spaced apart input devices, each input device being associated with a musical note wherein the input devices are arranged in a pattern such that each pair of nearest neighbor input devices positioned in a first direction relative to each other are tonally spaced seven half steps from each other, each pair of nearest neighbor input devices positioned in a second direction relative to each other are tonally spaced three half steps from each other; and each pair of nearest neighbor input devices positioned in a third direction relative to each other are tonally spaced four half steps from each other.

Another aspect of the invention is a display device for the representation of musical notes and chords, a chord comprising a plurality of musical notes, wherein chords are classified into types according to the number of notes in the chord and the tonal relationship among the notes. Such a device has a plurality of display elements, each display element being associated with a note, where the plurality of display elements are arranged in spatial relationship to each other such that the relative spatial relationship of the subset of display elements required to display a type of chord is the same for all chords of that type.

A still further aspect of the invention is a device where a first relative spatial relationship of three spatially contiguous display elements respectively produces or represents a major chord, a second relative spatial relationship, different from the first relative spatial relationship, of three spatially contiguous display elements respectively produces or represents a minor chord, a third relative spatial relationship, different from the first and second relative spatial relationships, of three spatially contiguous display elements respectively produces or represents an augmented triad, and a fourth relative spatial relationship, different from the first, second and third relative spatial relationships, of three spatially contiguous display elements respectively produces or represents a diminished triad.

Yet another aspect of the invention is a display device for the visual display of musical notes having a plurality of spaced apart display elements, each input device being associated with a musical note wherein the input devices are arranged in a pattern such that each pair of nearest neighbor display elements positioned in a first direction relative to each other are tonally spaced seven half steps from each other. The device is arranged such that each pair of nearest neighbor display elements positioned in a second direction relative to each other are tonally spaced three half steps from each other; and each pair of nearest neighbor display elements positioned in a third direction relative to each other are tonally spaced four half steps from each other.

Other features and advantages of the present invention will be apparent to those skilled in the art from the following detailed description, the accompanying drawings and the appended claims.

BRIEF DESCRIPTION OF THE DRAWINGS

The benefits and advantages of the present invention will become more readily apparent to those of ordinary skill in the relevant art after reviewing the following detailed description and accompany drawings, wherein.

DETAILED DESCRIPTION OF THE INVENTION

Figure 1:
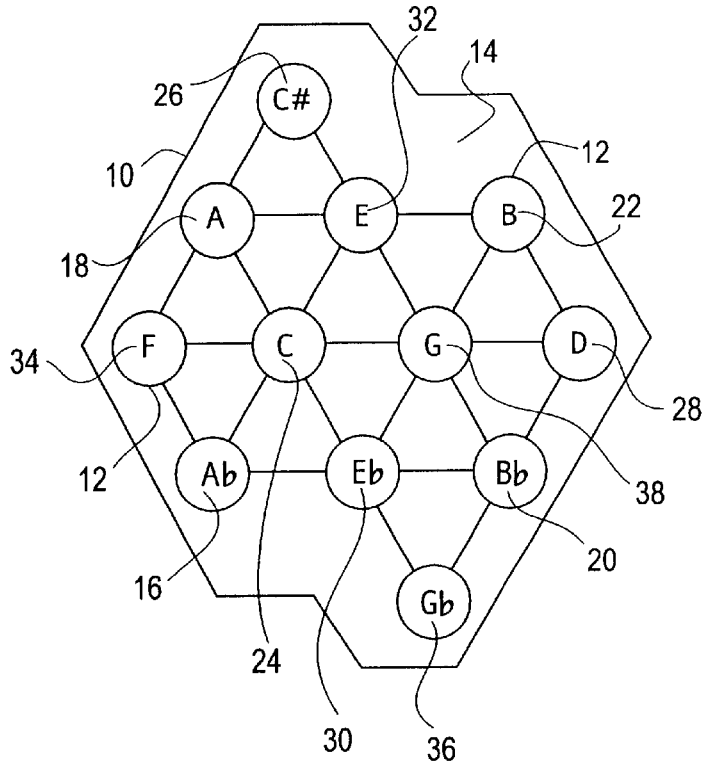
FIG. 1 is a top view of a simple trichord.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It is to be further understood that the title of this section of the specification, namely, "detailed Description of the Invention" relates to a requirement of the United States Patent and Trademark Office, and is not intended to, does not imply, nor should be inferred to limit the subject matter disclosed herein or the scope of the invention.

The fundamental harmonic relationships among the tones of a chromatic scale are explained by a solid theoretical model, and have been long known. See Hall, Donald, E. *Musical Acoustics,* 450 (Wadsworth Publishing, 1980). One power of such a theoretical model is that it defines many musical relationships among the notes in a spatially consistent fashion. That is, a once a student has learned the pattern that defines a major scale or a minor scale, the same pattern applies to the scales in all keys. Similarly, once a student has learned a pattern for a chord in one key, it applies to all keys.

For example, four basic three-note chord types (or triads) are major triads, minor triads, augmented triads, and diminished triads. In the instrument of the present invention, each triad is represented by a simple shape that can be learned by anyone in only a few minutes. Once these basic shapes are learned, those triads may be played in any key by spatial transposition. The correspondence between aural and visual cues reinforces the harmonic and geometric relationships in a fundamentally intuitive way.

Figure 6:
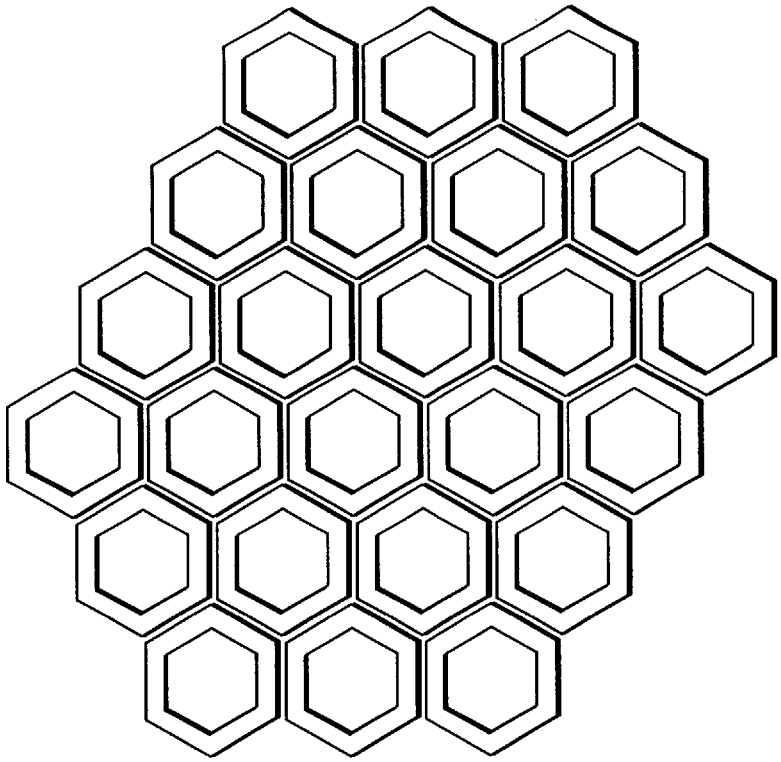
FIG. 6 is a top view of a concert trichord.

Referring to the Figures, and in particular to FIGS. 1 and 6, there are shown two embodiments of the present invention. The present musical instrument, a trichord 10, comprises a plurality of buttons 12 which are arranged on a trichord surface 14 in a geometric form which reflects the fundamental harmonic relationships among the tones of the chromatic scale. FIG. 1 shows a simple trichord 10 with twelve buttons 12 arranged on a surface in a geometric form which reflects the fundamental harmonic relationships among the twelve tones of a chromatic scale. FIG. 6 illustrates a concert trichord 100 with twenty-four hexagonal boxes assembled in a geometric form which reflects the fundamental harmonic relationships among the tones.

The two embodiments described herein can send and receive MIDI signals. Signals sent by the instrument can be made audible by a wide variety of MIDI interfaces, and signals received can be similarly made visible through the MIDI interface.

Figure 2:
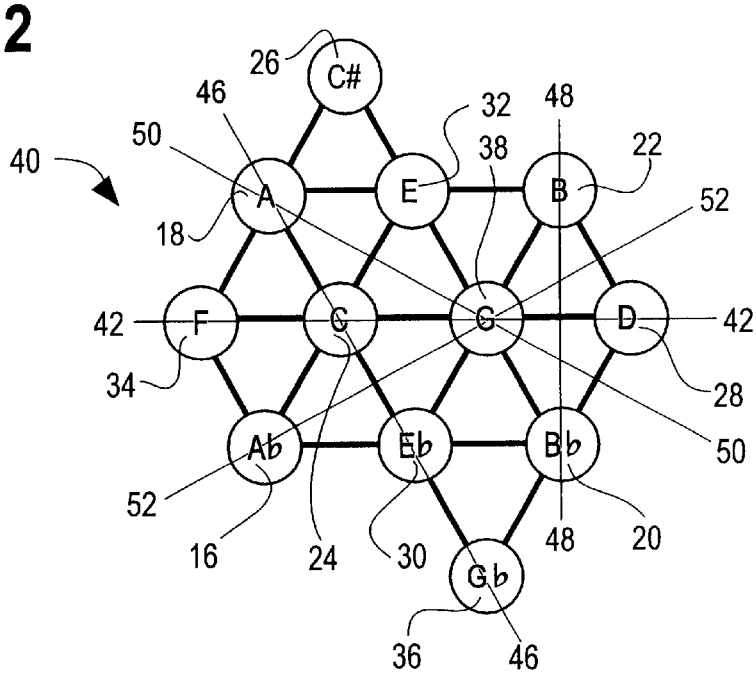
FIG. 2 is a pitch map for a simple trichord.

One octave of a chromatic scale comprises the notes Ab 16, A 18, Bb 20, B 22, C 24, C# 26, D 28, Eb 30, E 32, F 34, Gb 36, and G 38, wherein the symbol "b" represents flats and the symbol "#" represents sharps. An octave contains 12 notes, but as will be understood by those of ordinary skill in the art, chromatic scales can begin on notes other than Ab 16, with Ab 16 following G 38. Chromatic scales contain the tones in the order given, but may comprise a fractional octave or more than one octave. FIG. 2 depicts an arrangement 40 of the notes that reflects the fundamental harmonic relationships among the tones of the chromatic scale, constituting harmonic relationship pattern means. The relative position of the tones is important for the present invention, but not a particular orientation. Further, the entire field could also be shifted, i.e. the central notes do not need to be C 24 and G 38. Therefore, as will be understood by those of ordinary skill in the art, in the embodiment of FIG. 1, G 38 must be surrounded by E 32, B 22, D 28, Bb 20, Eb 30, and C 24, but these notes could just as easily surround G 38 in a counter-clockwise fashion, as the depicted clockwise fashion. The notes E 32, B 22, D 28, Bb 20, Eb 30, and C 24 are adjacent to the note G 38 and notes E 32 and D 28 are adjacent to B 22, notes B 22 and Bb 20 are adjacent to D 28, and so on around. The whole arrangement can also be rotated without affecting its function.

Figure 7:
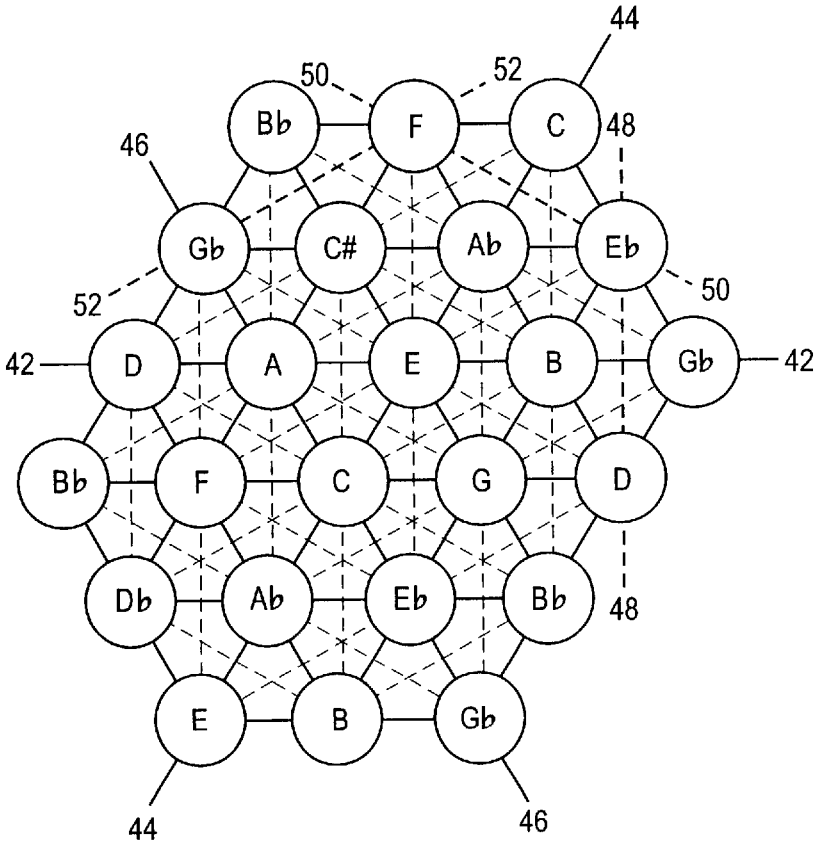
FIG. 7 shows a pitch map of a concert trichord.

The patterns of FIGS. 2 and 7 are easily extended to cover an instrument with any number of notes. The patterns of FIGS. 2 and 7 have three lines of nearest neighbors. As can be seen by those of ordinary skill in the art, along a first direction (or line) of nearest neighbors 42, the tones rise by a perfect fifth (seven half steps) moving from left to right. Along a second direction (or line) of nearest neighbors 44, the tones rise by a major third (four half steps) following a diagonal line upward and to the right. Along a third direction (or line) of nearest neighbors 46, tones rise by a minor third (three half steps) moving downward and to the right.

Along a first direction (or line) of next nearest neighbors 48, the tones rise by a minor second (one half steps) moving from bottom to top. Along a second direction (or line) of nearest neighbors 50, the tones rise by a minor seventh (ten half steps) following a slanted line down and to the right. Along a third direction (or line) of nearest neighbors 52, tones rise by a major seventh (eleven half steps) along a slanted line moving up and to the right.

Figure 3A:
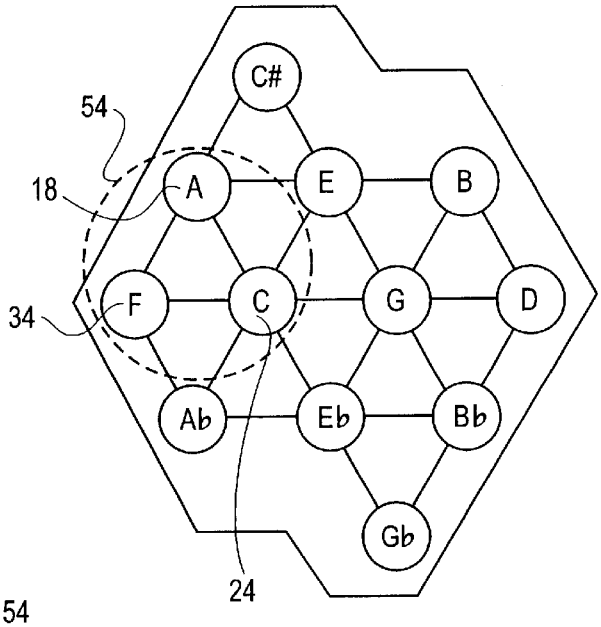
FIGS. 3A–C display the playing of major triads.
Figure 3B:
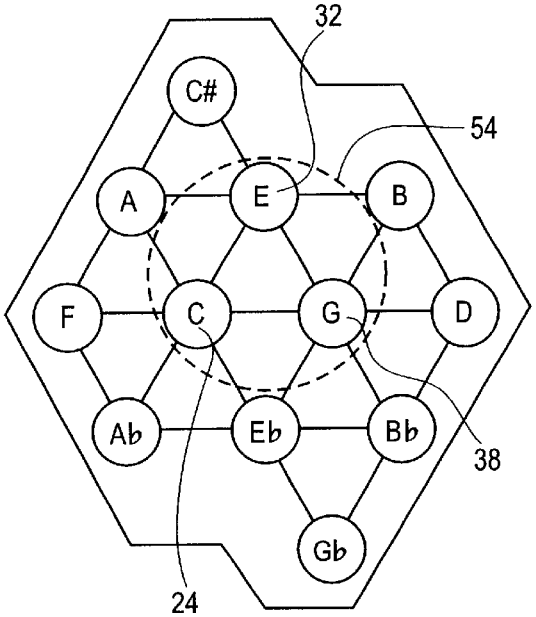
Figure 3C:
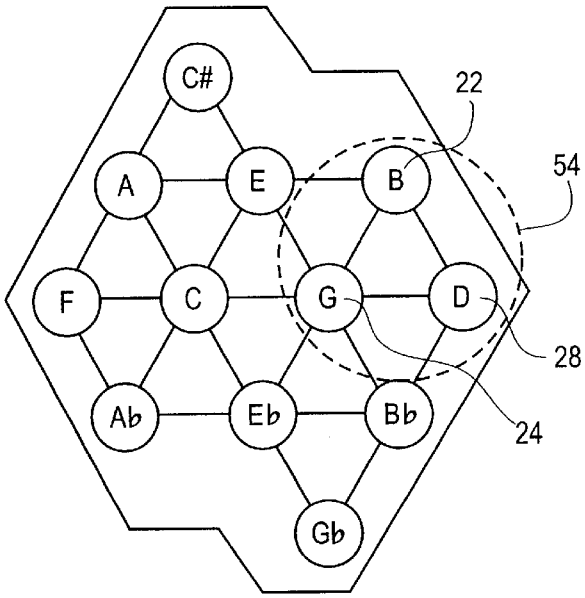
Figure 4A:
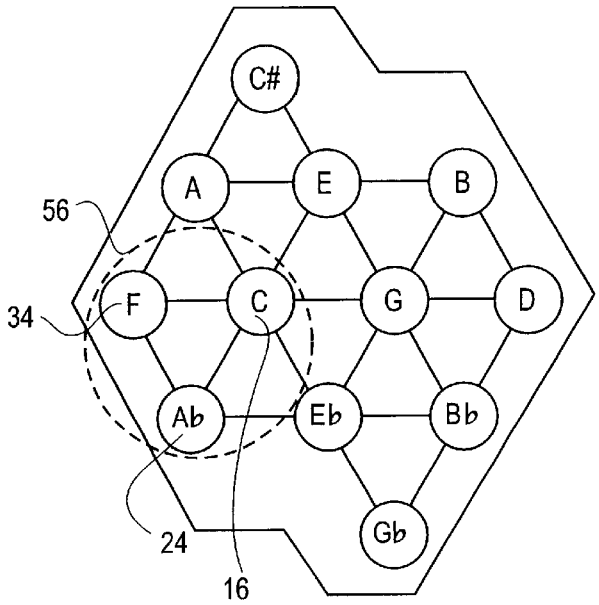
FIGS. 4A–C display the playing of minor triads.
Figure 4B:
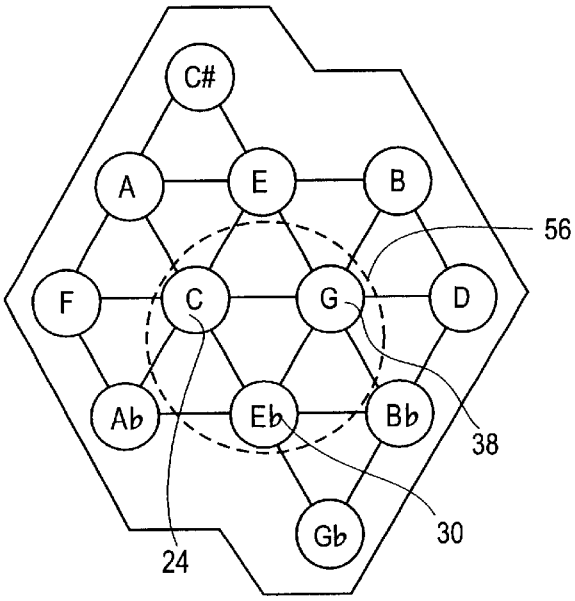
Figure 4C:
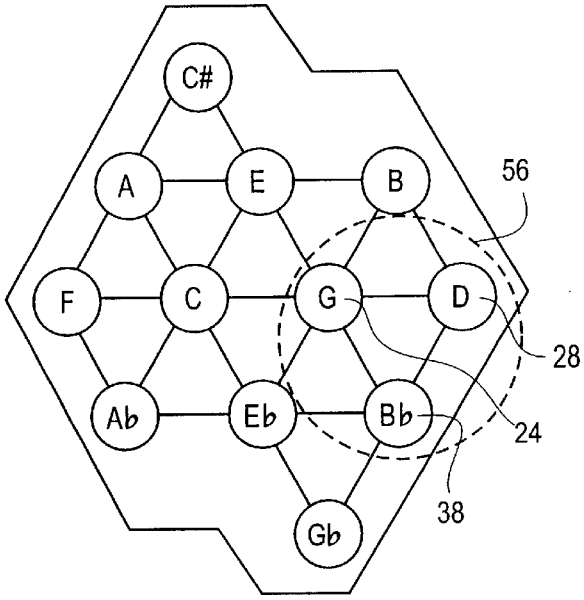
Figure 5A:
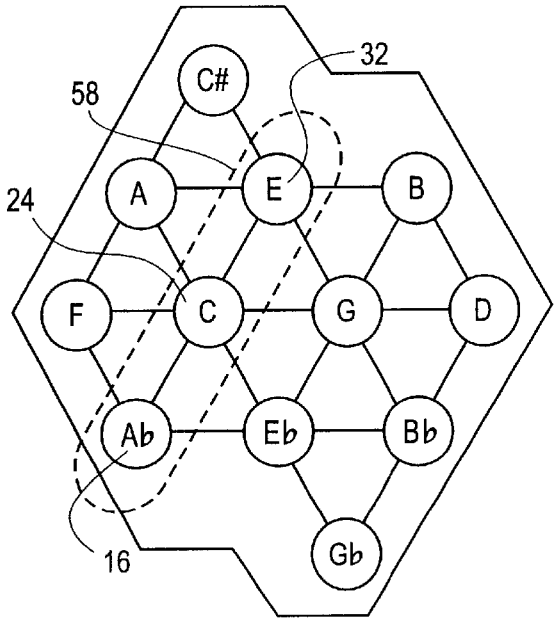
FIGS. 5A–B display the playing of augmented and diminished triads.
Figure 5B:
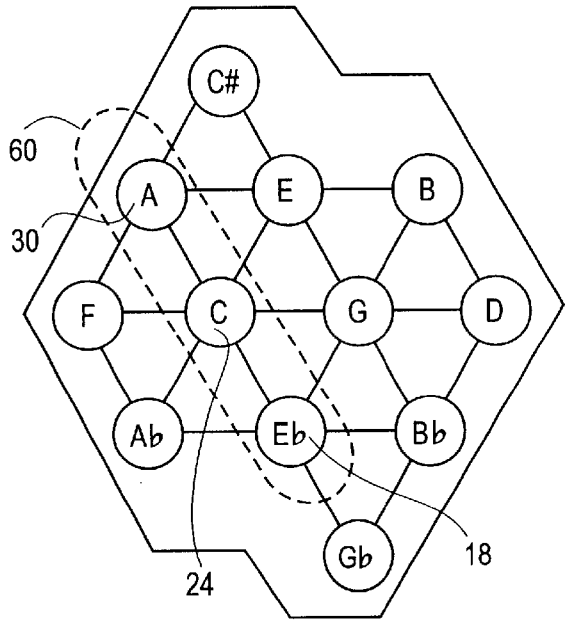

Referring to FIGS. 3–5, basic three-note chord types (triads) are represented on the trichord 10. Major triads 54 are depicted in FIGS. 3A–C, minor triads 56 in FIGS. 4A–C, and augmented 58 and diminished 60 triads in FIG. 5A–B, respectively. Those of ordinary skill can readily discern the patterns for a large number of other chords. The arrangement of the notes generated by different buttons 12 in accordance to the fundamental harmonic relationship as opposed to chromatic or diatonic relationship allows these triads to be played or displayed by a simple shape. The three tones form a triangle in which all of the tones are adjacent and contiguous to each other (in the cases of major and minor triads), or in a straight line of three tones (in the cases of augmented or diminished triads), without any other intervening tones, and are thereby contiguous. Large numbers of more complicated chords will not be contiguous, but will still be defined by a spatial pattern that transposes musically by merely shifting along the grid. An example of the educational power of these patterns is that it greatly facilitates learning to play chord progressions.

As illustrated in FIGS. 3A–C, a major triad 54 is a triangle of three adjacent notes pointing upwards with the name of the triad taken from the note in the leftmost member. Thus, FIG. 3A shows the notes played or displayed for F Major, a subdominant (IV) triad, made of the notes F-A-C 34 18 24, FIG. 3B shows the notes played or displayed for C Major, a tonic (I) triad, made of the notes C-E-G 24 32 38, and FIG. 3C shows the notes played or displayed for G Major, a dominant (V) triad, made of the notes G-B-D 24 22 28.

As shown by FIGS. 4A–C, a minor triad 56 is a triangle of three adjacent notes pointing downward with the name of the triad taken from the note in the leftmost member. Thus, FIG. 4A shows the notes played or displayed for F Minor, a subdominant (iv) triad, made of the notes F-Ab-C 24 16 24, FIG. 4B shows the notes played or displayed for C Minor, a tonic (i) triad, made of the notes C-Eb-G 24 30 38, and FIG. 4C shows the notes played or displayed for G Minor, made of the notes G-Bb-D 38 20 28.

As depicted in FIGS. 5A–B, an augmented triad 58 is a straight line of three contiguous notes pointing upwards to the right and the diminished triad 60 is a straight line of three adjacent notes pointing down and to the right. Thus, FIG. 5A shows the notes played or displayed for an augmented triad of Ab-C-E 16 24 32, and FIG. 4B shows the notes played or displayed for a diminished triad of A-C-Eb 18 24 30.

The embodiment of FIGS. 1 & 3–5 comprises a plurality of buttons 12 mounted in a trichord surface 14, which is preferably a wooden frame, but could be any material. The buttons are connected to a micro-controller board (not shown) which scans the switches, detects when they are pressed, and sends an appropriate message from, for example, a serial port to an external sound generating device. In the illustrated embodiment, the MIDI (Musical Instrument Digital Interface) standard protocol is used for this purpose.

As will be understood by those of ordinary skill in the art, a large variety of input means can be used. Tactile input devices such as touch pads, buttons monitored by opto-electrical switches, lever-like keys, and the like can be used. The input devices can also be activation zones on a computer screen that can be activated by a mouse. The input devices can be sound generating devices or tool activated input devices including idiophones such as gongs, as chimes or pipes. The present invention contemplates all such input devices and input means. While the present embodiments are implemented as MIDI devices, the invention is not limited to MIDI implementations and also encompasses alternatives such as hard-wired implementations that do not use MIDI interfaces, or even direct physical playing of a note by mechanical means.

Those of ordinary skill in the art will also appreciate that the buttons 12 can be implemented either as simple on/off switches or can be implemented to impart additional information. Various switches known to those of ordinary skill can transmit information regarding nuances in how a note is played to the micro-controller board. The nuances can be implemented in a number of ways, such as measuring the velocity with which a button 12 is pressed, or detecting how far a button has been pressed down. These nuances, when passed on to the exemplary MIDI sound generating device can vary the sound of the note in a number of ways including, but not limited to, volume or vibrato.

One aspect of the invention relates to the playing of music. In the embodiment illustrated in FIGS. 1 & 2–5, when a button 12 is pressed, the micro-controller sends a MIDI Note On command through it's MIDI Out port. The sound that is played is determined by the MIDI instrument that the Trichord is plugged into. When the button is released a MIDI Note Off command is transmitted. When multiple buttons are pressed, multiple Note on commands are sent.

The space between the buttons 12 is ergonomically designed so that triads 54 56 58 60 can be easily played with one hand. The arrangement of the buttons 12 facilitates the physically easy playing of triads in an intuitive way. For example, in the instrument of FIG. 1, depressing the C 24, E 32, and G 38 buttons plays a C-Major chord, while depressing the F 34, A 18, and C 24 buttons plays an F Major chord. The arrangement of notes on the musical instrument 10 of the present invention are such that pressing three buttons patterned in an upwardly pointing triangles results in the playing of the major chord or triad 54 named after the note in the lower left hand corner. Similarly, the note on the musical instrument of the present invention are arranged such that pressing three buttons patterned in a downwardly pointing triangle, such as F 34, Ab 16, and C 24 buttons, results in the playing of the minor chord or triad 56 named after the note in the upper left hand corner. Augmented 58 and diminished triads 60 can also be played according to the illustrations of FIG. 5 as discussed above.

Another aspect of the invention relates to the display of the music being played. Optionally, as shown in the exemplary embodiment of FIGS. 1–6, the trichord can also include a plurality of display elements, preferably LEDs (Light-Emitting Diodes) encased in the translucent plastic buttons 12. As will be understood by those skilled in the art, a wide variety of display elements are available including light bulbs, LEDs, flames, rotating colored panels, etc can be used for display purposes. Preferably, as in the illustrated embodiment, these LEDs are located inside the buttons. The LEDs are connected to the MIDI network. When a note is played, MIDI data is received at the display's MIDI In port. When a MIDI "Note On" command is received by the display module, the LED that corresponds to the note being played is lit by the microcontroller board.

The instrument of the present invention can also be used as a display device. As mentioned above, the embodiment of FIGS. 1 & 3–5 has a micro-controller board adapted for use with MIDI devices. By connecting any MIDI input stream to the instrument, all of the notes that are being played on another MIDI musical instrument can be displayed in real time on the instrument display, in this case on the appropriate LEDs encapsulated on the buttons 12. Likewise, the display can be provided on an external device (not shown), such as, for example, a monitor.

The instrument display has the unique feature of visually representing the harmonic structure of the music being played in an intuitive and immediately appreciable way. The display consists of the same pattern of pitches as for playing the instrument. As each note is played the corresponding display element on the display is lit. This creates a direct visual feedback component which is previously not known. There can be many subtleties, nuances and variations in the way notes are displayed. As an example, one of the more interesting nuances controls the color or brightness of a display element based upon the frequency and/or duration of the pitch's occurrence in the music. This will visually identify tonal centers as the music is being played in a manner which will be clearer to music students than most of them can discern aurally. In any event, even for skilled musicians, the visual cues are generally easier to decipher than aural ones.

Another embodiment of the present invention is displayed in FIGS. 6–13. A "concert" embodiment of the instrument 100 shown in FIG. 6 includes a plurality of modules 102. A preferred tone map for the embodiment of FIGS. 6–13 is given in FIG. 7. The modules 102, illustrated in FIG. 6, are preferably hexagonal. As will be apparent to those of ordinary skill in the art, the number of modules 102 can be greater or less than twenty-four. Although the illustrated embodiment 100 has twenty-four modules 102, instruments 100 with larger numbers of modules 102 may be desired musically despite being more expensive or difficult to build, and instruments with fewer modules 102 are still contemplated by the present invention. Those of ordinary skill will understand that the size of the modules 102 can be increased or decreased, or the number of modules 102 can be increased by deepening or widening the instrument 100. For example, an artisan of ordinary skill could implement this as a three-sided console with a large number of modules 102. As will be appreciated by those of ordinary skill, the modules 102 can be of any shape, as long as the relative positioning of the modules 102 is constant. For example round or square modules could be used instead of hexagonal modules. To facilitate ease of play, the modules 102 are preferably assembled in a tiered fashion, such that the modules 102 nearer the player are lower than the farther modules 102, thus requiring less reach.

Figure 8:
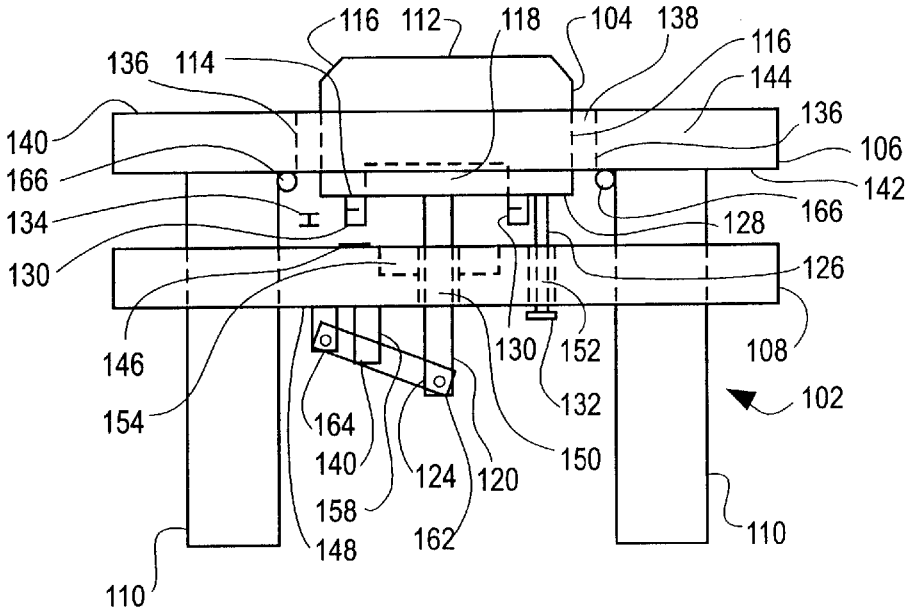
FIG. 8 displays a side view of a module of a concert trichord.
Figure 9:
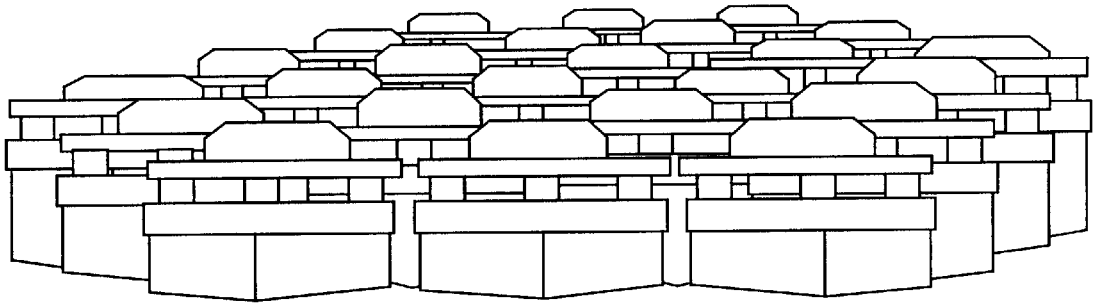
FIG. 9 is a front view of a concert trichord.
Figure 10:
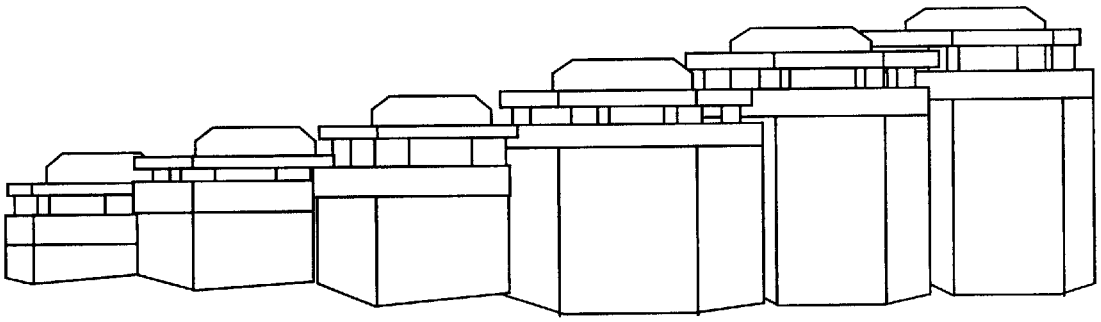
FIG. 10 is a left view of a concert trichord.
Figure 11:
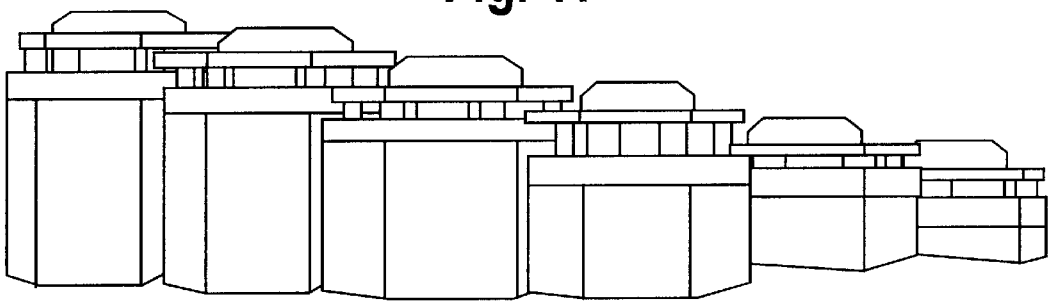
FIG. 11 is a right view of a concert trichord.
Figure 12:
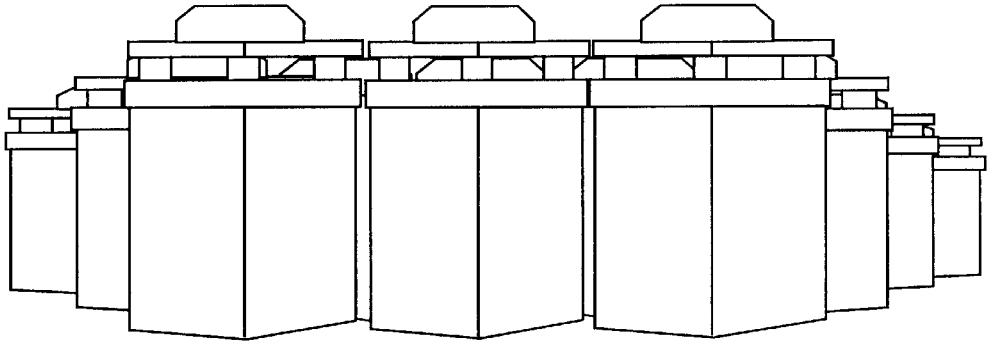
FIG. 12 is a back view of a concert trichord.
Figure 13:
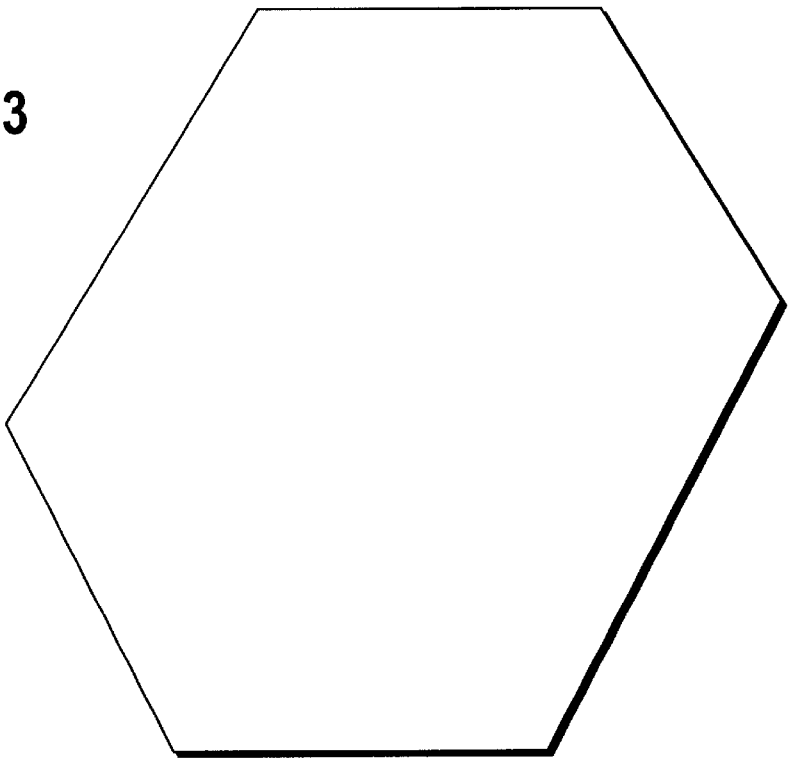
FIG. 13 is a bottom view of a concert trichord.

Referring to FIG. 8, each module 102 comprises a button 104, a button frame 106, a base 108, and a plurality of 110 legs. A button 104 is preferably a hexagonal piece of cherry wood having a top side 112 and a bottom side 114 and peripheral edges 116. The bottom side 114 holds a first magnet 118 (or button magnet) having a first polarity located in the button 104. Preferably, a hollow ring magnet is used.

An actuating dowel 120 depends from the button 104. The actuating dowel 120 is preferably round and located in the center of the button. A flag 124 (or flag portion) is attached to the actuating dowel 120. One or more restraining dowels 126 depend from the bottom side 114 of the button, preferably near the periphery 128. More preferably, three restraining dowels 126 are used in spaced relationship around the button 104. Each restraining dowel 126 has a stop 132.

One or more resilient, compressible members 130 is placed on the bottom side 114 of the button 104. Preferably three rubber pads are used as resilient, compressible members 130 and are placed in spaced relationship around the bottom side 114 of the button. The resilient compressible members 130 are capable of being compressed a compression distance 134 along the downward direction from the restraining dowel 126.

A button frame 106, preferably hexagonal, having interior edges 136 that define a button passage 138 sized to permit passage of the button up and down through the frame 106, is positioned to surround the button 104. Preferably, the frame 106 is sized such that the interior edges 136 are spaced from the peripheral edges 116 of the button 104. The button frame 106 has a top surface 140 and a bottom surface 142 separated by a frame thickness 144. A plurality of legs 110, preferably six, depend from the button frame 106, preferably at the corners 144 of the button frame 106. The base 108 of the module 100 is spaced from the button frame 106 and connected to the plurality of legs 110.

The base 108 is a board, preferably hexagonal, spaced from and beneath the button frame 106, connecting the six legs 110. The base 106 has a top surface 146 spaced from a bottom surface 148. The base 106 defines an actuating aperture 150 sized at least large enough for the actuating dowel 120 of the button 104 to pass through, and openings 152 large enough for the restraining dowels 126 to pass through, but not the stops 132 thereof.

The base 108 also has a base magnet 154 in the form of a ring magnet positioned around the actuating aperture 150 and underneath the button magnet 118, and having a polarity matched with that of the button magnet 118. The same polarities of the base magnet 154 and the button magnet 118 cause the two magnets to repel each other and float the button 106 above the base 108, pressing the stops 132 against the bottom surface 148 of the base 106. Preferably, the resulting flotation maintains the resiliently compressible members 130 spaced from the top surface 146 of the base 106 a distance equal to the compression distance 134 of the rubber pads.

A detector 156 is attached to the bottom surface of the base. Preferably, the detector 156 is an opto-electrical emitter-detector comprising an infrared source and an infrared detector. In such an embodiment, an source 158 and the sensor 160 are placed on opposite sides of the flag 124 attached to the actuating dowel 120 of the button 106.

When the button 104 is in the off (or rest or default) position, the resilient compressible members 130 are suspended above the top surface 146 of the base 106 at a distance approximately equal to the compression distance 134 of the resiliently compressible members 130, and the flag portion 124 of the actuating dowel 120 blocks light emitted from the source 158 from reaching the sensor 160.

When the button 104 is pressed down, the flag 124 permits the passage of light from the source 158 to the detector 160. Desirably, half of the light available from the source 158 will be passed to the sensor 160 when the button 104 is pressed such that the resiliently compressible members 130 contact the top surface 146 of the base 106, but do not significantly compress it. Such a position is a gently pressed or half-pressed position.

When the button 104 is pressed hard enough to fully compress the resiliently compressible members 130, such a position is a firmly pressed or fully pressed position. The passage of light past the flag 124 is maximized at the firmly pressed or fully pressed position.

The output of the detector 156 can be sent to a multi-channel analog to digital converter which produces a digital signal that identifies the channel and the level of output of the detector 156. The digital signal is then sent to a micro-controller board and translated into a MIDI signal. The micro-controller board (not shown) then sends an appropriate message out of a serial port to an external sound generating device. In the illustrated embodiment, the MIDI (Musical Instrument Digital Interface) standard protocol is used for this purpose.

Software can then control the sound effects of the pressing of a button 104. In a preferred mode of operation, the pressing of the button 104 from the resting position to the gently pressed results in a MIDI Note On command being sent. As the button 104 is pressed from gently pressed to fully pressed, the light transmitted from the source 158 to the detector 160 is measured. In the case of an opto-electrical switch, the signal is an analog signal and inversely proportional to the light blocked by the flag 124. The analog to digital converter then converts the analog signal to a digital signal. With software that uses the digital signal to control the sound volume or vibrato, the sound generated can thereby depend on the amount of light measured. For example, the volume of the tone, or degree of vibrato can be linked to the pressure on the button providing the player of the instrument with the options for nuanced play.

As shown in FIG. 7, one end 162 of the flag 124 can be pinned in the actuating dowel 120, allowing rotation around the pin. The other end 164 of the flag 124 can be pinned. Such an arrangement will attenuate the movement of the flag 124, allowing an increased length of travel of the button 106 within a range of sensitivity of the detector 156.

Desirably, display (or lighting) elements 166 are installed in each module 102. The lighting elements 166 can be attached to the base 108, underneath the button 104, on the button 104, or on the button frame 106. As will be understood by those of ordinary skill in the art, a wide variety of lighting approaches can be used. One approach would be to place pairs of light emitting diodes on the base 106 underneath the button 104 in 3 pairs underneath respective adjacent edges of the button 104. Desirably, each of the three pairs is a different color. When other musical devices capable of communicating their play electronically are attached, different colors can display the play of those other musical devices. For example, if three trichords 100 were connected, blue lights could display the pressing of the buttons 104 of the first trichord 100. The red and white lights could be used to display the play of the other two trichords 100 respectively. Another example would be to split a MIDI signal coming from a MIDI keyboard, sending the signal to both a sound generating device to be heard, and to the display of the present invention to be visually displayed. A trichord 100 player could then play along with a piano player by following the pattern of lights.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

I claim:

1. A device for the input of musical notes and chords, a chord comprising a plurality of musical notes, wherein chords are classified into types according to a number of notes in the chord and a tonal relationship among the notes, comprising: a plurality of input devices, each input device being associated with a note, where a subset of the plurality of input devices are arranged in spatial relationship to each other such that the relative spatial relationship of the subset required to play a type of chord is the same for all chords of that type, wherein a first relative spatial relationship of three spatially contiguous input devices respectively produces or represents a major chord, a second relative spatial relationship, different from the first relative spatial relationship, of three spatially contiguous input devices respectively produces or represents a minor chord, a third relative spatial relationship, different from the first and second relative spatial relationships, of three spatially contiguous input devices respectively produces or represents an augmented triad, and a fourth relative spatial relationship, different from the first, second and third relative spatial relationships, of three spatially contiguous input devices respectively produces or represents a diminished triad.

2. The device of claim 1 wherein the first relative spatial relationship is a triangle pointed in a first direction, the second relative spatial relationship is a triangle pointed in a second direction, opposite to tie first direction, the third relative spatial relationship is a first line, and the fourth relative spatial relationship is a second line transverse to the first line.

3. The instrument of claim 1, further including a plurality of display elements, each display element being associated with a note wherein the activation of a input device actuates the display clement associated with its respective input device.

4. The device of claim 1, wherein the input devices are tactile input devices.

5. The device of claim 1, wherein the input devices are idiophones.

6. A device for the input of musical notes, comprising:

a plurality of spaced apart input devices, each input device being associated with a musical note wherein the input devices are arranged in a pattern such that a pair of nearest neighbor input devices positioned in a first direction relative to each other are tonally spaced seven half steps from each other;

a pair of nearest neighbor input devices positioned in a second direction relative to each other are tonally spaced three half steps from each other; and a pair of nearest neighbor input devices positioned in a third direction relative to each other are tonally spaced four half steps from each other.

7. The device of claim 6, further including a plurality of display elements, each display element being associated with a note wherein the activation of a display element activates the display element associated with its respective display element.

8. The device of claim 7, wherein a display property selected from the group of brightness and color is based upon a musical quality selected from the group of pitch frequency and pitch duration and the display elements associated with that note have the display property varied based on the musical quality.

9. The device of claim 7, for use in cooperation with another instrument that sends musical signals, further comprising a second plurality of display elements, each display element of the second plurality being associated with a note, such that when the a musical signal is received from another instrument, it is displayed on the second plurality of display elements.

10. A display device for the representation of played musical notes and chords, a chord comprising a plurality of musical notes, wherein chords are classified into types according to the number of notes in the chord and the tonal relationship among the notes, the display device comprising:

a plurality of display elements, each display element being activated as an associated note is played, wherein the display elements are arranged in spatial relationship to each other such that the relative spatial relationship of the subset of display elements required to display a type of chord is the same for all chords of that type.

11. The device of claim 10, wherein a display property selected from the group of brightness and color is based upon a musical quality selected from the group of pitch frequency and pitch duration and the display elements associated with that note have the display property varied based on the musical quality.

12. The device of claim 10, for use in cooperation with another instrument that sends musical signals, further comprising a second plurality of display elements, each display element of the second plurality being associated with a note, such that when the a musical signal is received from another instrument, it is displayed on the second plurality of display elements.

13. The device according to claim 10, wherein a first relative spatial relationship of three spatially contiguous display elements respectively represents a major chord, a second relative spatial relationship, different from the first relative spatial relationship, of three spatially contiguous display elements respectively represents a minor chord, a third relative spatial relationship, different from the first and second relative spatial relationships, of three spatially contiguous display elements respectively represents an augmented triad, and a fourth relative spatial relationship, different from the first, second and third relative spatial relationships, of three spatially contiguous display elements respectively represents a diminished triad.

14. The device according to claim 13 wherein the first relative spatial relationship is a triangle pointed in a first direction, the second relative spatial relationship is a triangle pointed in a second direction, opposite to the first direction, the third relative spatial relationship is a first line, and the fourth relative spatial relationship is a second line transverse to the first line.

15. A display device for the visual display of musical notes comprising:

a plurality of spaced apart display elements, each display element being associated with a musical note wherein the display elements are arranged in a pattern such that each pair of nearest neighbor display elements positioned in a first direction relative to each other are tonally spaced seven half steps from each other;

each pair of nearest neighbor display elements positioned in a second direction relative to each other are tonally spaced three half steps from each other; and each pair of nearest neighbor display elements positioned in a third direction relative to each other are tonally spaced four half steps from each other.

16. A device for the input of musical notes and chords, a chord comprising a plurality of musical notes, wherein chords are classified into types according to a number of notes in the chord and a tonal relationship among the notes, comprising:

a plurality of input devices, each input device being associated with a note, wherein a subset of the plurality of input devices are arranged in spatial relationship to each other such that the relative spatial relationship of the subset required to play a type of chord is the same for all chords of that type;

and a plurality of display elements, each display element being associated with a note wherein the activation of an input device activates the display element associated with the same note as the input device.

17. The device according to claim 16, wherein a first relative spatial relationship of three spatially contiguous input devices respectively produces or represents a major chord, a second relative spatial relationship, different from the first relative spatial relationship, of three spatially contiguous input devices respectively produces or represents a minor chord, a third relative spatial relationship, different from the first and second relative spatial relationships, of three spatially contiguous input devices respectively produces or represents an augmented triad, and a fourth relative spatial relationship, different from the first, second and third relative spatial relationships, of three spatially contiguous input devices respectively produces or represents a diminished triad.

18. The device of claim 17 wherein the first relative spatial relationship is a triangle pointed in a first direction, the second relative spatial relationship is a triangle pointed in a second direction, opposite to the first direction, the third relative spatial relationship is a first line, and the fourth relative spatial relationship is a second line transverse to the first line.

19. A device for the representation of played musical notes and chords of claim 12, further comprising a plurality of input devices for playing the associated notes.

* * * * *